US006796465B1

(12) United States Patent
Chavez

(10) Patent No.: US 6,796,465 B1
(45) Date of Patent: Sep. 28, 2004

(54) MULTIPLE OUTPUT KEG COUPLER

(75) Inventor: Ubaldo Rafael Chavez, P.O. Box 1083, Santa Barbara, CA (US) 93102-1083

(73) Assignee: Ubaldo Rafael Chavez, Santa Barbara, CA (US)

( * ) Notice: Subject to any disclaimer, the term of this patent is extended or adjusted under 35 U.S.C. 154(b) by 0 days.

(21) Appl. No.: 10/388,919

(22) Filed: Mar. 14, 2003

(51) Int. Cl.[7] ..... B67D 3/00

(52) U.S. Cl. ..... 222/486; 222/478; 137/883

(58) Field of Search ..... 222/478, 481, 222/482, 484–486; 141/236, 237, 243, 244; 137/561 A, 625, 625.18, 625.42, 861, 883

(56) References Cited

U.S. PATENT DOCUMENTS

| | | | | | |
|---|---|---|---|---|---|
| 2,006,393 | A | * | 7/1935 | Hapgood | 141/57 |
| 6,047,866 | A | * | 4/2000 | Brown | 222/608 |
| 6,260,580 | B1 | * | 7/2001 | Shipley | 137/883 |
| 6,557,594 | B2 | * | 5/2003 | Guzman | 141/240 |

* cited by examiner

*Primary Examiner*—J. Casimer Jacyna

(57) ABSTRACT

A conventional keg coupler and hand pump assembly is improved with a new multiple output coupler fitting which allows an increase in output flow. No physical change is made to said coupler and pump assembly just a replacement of fittings. In addition the length of elastomeric tubing which connects to the multiple output coupler fitting ends and the faucets is shortened to a length of less than 24 inches to decrease foaming but keep adequate pressure.

1 Claim, 3 Drawing Sheets

MULTIPLE OUTPUT KEG COUPLER

CROSS REFERENCE TO RELATED APPLICATIONS

464021, John Hartin, filled on Jul. 18, 1891. U.S. Pat. No. 4,436,228, John A. Frey, filled on Feb. 16, 1982. U.S. Pat. No. 4,350,273, James E. Nezworski, filled on Jun. 27, 1980. U.S. Pat. No. 4,291,821, James E. Nezworski filled on Oct. 4, 1979. U.S. Pat. No. 5,332,132, John Schuske, filled on Dec. 29, 1992.

STATEMENT REGARDING FEDERALLY SPONCERED DEVELOPMENT

"Not Applicable"

REFERENCE TO SEQUENCE LISTING, ATABLE, OR A COMPUTER PROGRAM LISTING COMPACT DISC APPENDIX

"Not Applicable"

BACKGROUND OF THE INVENTION

American and European Sankey style keg couplers come equipped with a standard one barbed hose fitting. This restricts the flow of beverage to one hose and one faucet therefore making the simple task of getting a beverage a time consuming process when more than one person is waiting.

The present invention increases the output flow by increasing the number of outputs. The fitting which simply replaces the standard one barb fitting easily screws in or on to existing coupler threads. No physical changes to the actual coupler occurs just a replacement of fittings. The preferred embodiment for said fitting can consist of an arrangement of two, four or six barbed hose adapters but is not limited to said amounts.

SUMMARY OF THE INVENTION

The main objective of this invention is to replace standard one barbed hose fittings that come stock on American and European Sankey style couplers with this new multiple barbed hose fitting, therefore allowing an increase in beverage output.

A conventional keg coupler is improved by replacing standard fitting with said new fitting adding two or more outputs. In addition the length of elastomeric tubing that transports beverage to faucet is decreased to a length of 24 inches to minimize foaming of beverage but still maintain adequate pressure. No physical change occurs to the keg coupler or faucets.

Before explaining the disclosed embodiment of the present invention in detail, it is to be understood that the invention is not limited in its application to the particular application shown, since the invention is designed to fit universally on any style coupler with proper ⅛ threaded female inlet. Also, the terminology used herein is for the purpose of description and not of limitation.

DETAILED DESCRIPTION OF THE INVENTION

Figure 7:
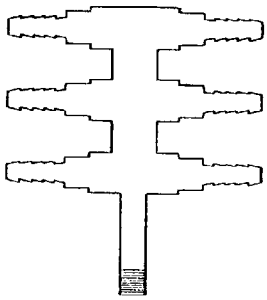
FIGS. 5–7 are possible output configuration models.
Figure 6:
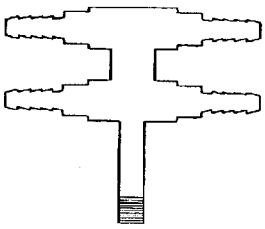
Figure 5:
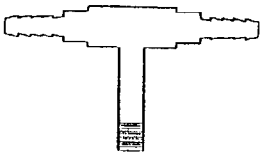
Figure 9:
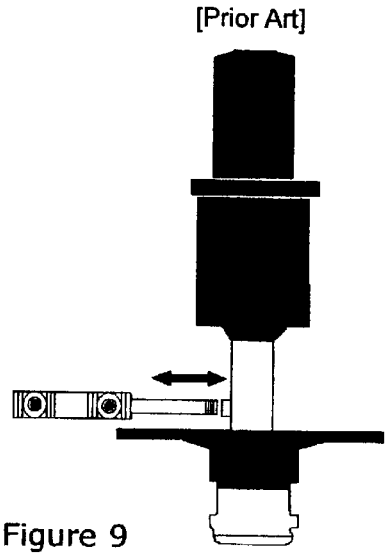
FIG. 9 is a side plan view of the demonstration in FIG. 8 with the use of a wing handle coupler and plastic pump assembly and without the tubing and faucet.
Figure 10:
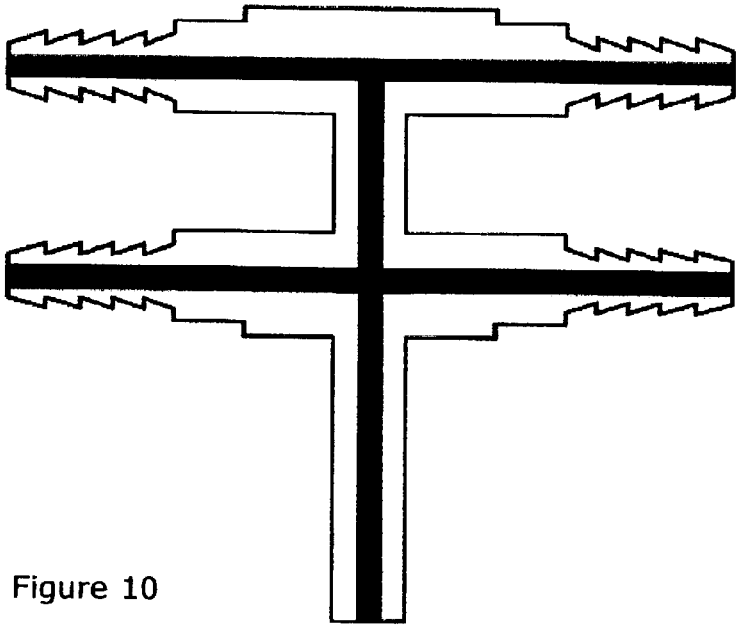
FIG. 10 is the top perspective view of a cutaway half of a one piece multiple output coupler fitting cast in brass.
Figure 11:
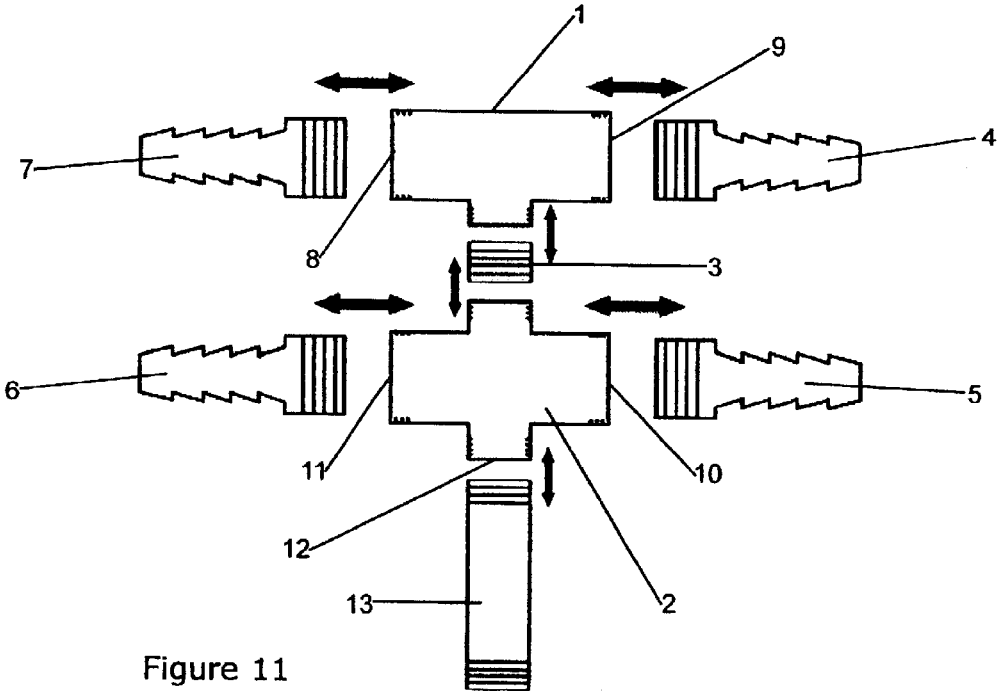
FIG. 11 is a top perspective view of each individual brass fitting needed to make a four output configuration.

The multiple output coupler fitting can be manufactured from existing brass fittings FIG. 11 or it can be cast as a one piece brass fitting FIG. 10 with hollow tubing and a wall thickness of 1/32 of an inch. To manufacture from existing fittings the output arrangement must first be determined. If a four output arrangement is desired like the one in FIG. 11 then one ⅛ inch diameter forged female threaded 'T'(1) must be connected to a ⅛ diameter inch forged cross (2) with male input threads by way of a ½ inch long ⅛ inch diameter dual male nipple(3). Then four ⅛ inch diameter barbed hose connecters (4,5,6,7) with threaded male ends must be connected to the four of the five female inputs (8,9,19,11) created with the configuration. The last ⅛ diameter female inlet (12) is connected to a 1½ inch long ⅛ diameter dual male nipple (13) and then connected to the coupler. To insure a water tight seal pipe joint compound is used whenever a male end connects with a female end. To achieve different configurations like the ones in FIGS. 5, 6 and 7 one simply adds or subtracts forged pipe crosses, nipples and barbed hose connectors to the desired configuration.

Figure 1:
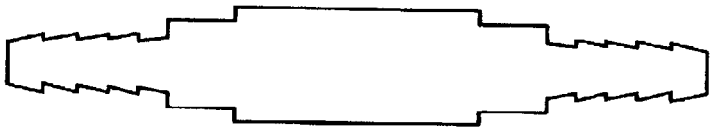
FIG. 1 is a top plan view of new multiple output coupler fitting.
Figure 2:
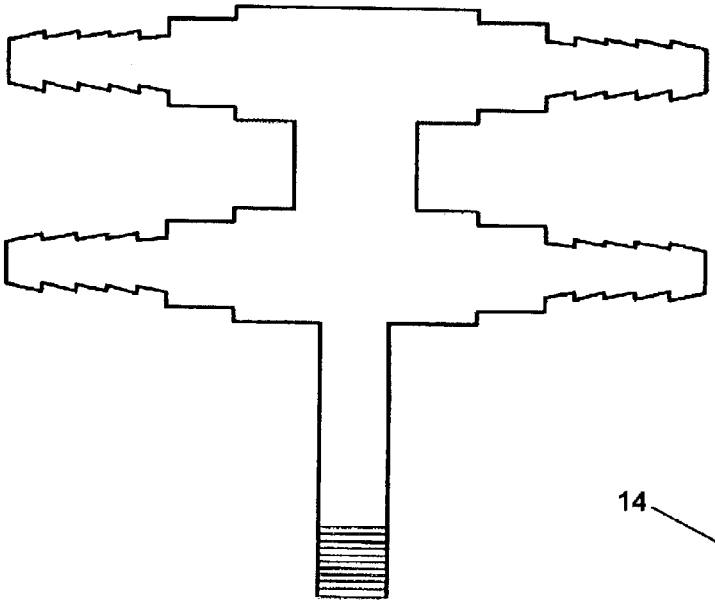
FIG. 2 is a top perspective view of new multiple output coupler fitting in a 4 output arrangement.
Figure 4:
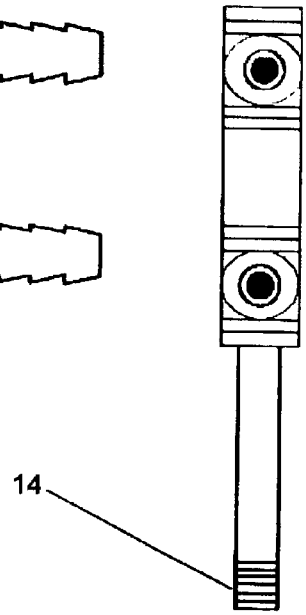
FIG. 4 is a side plan view of new multiple output coupler fitting.
Figure 3:
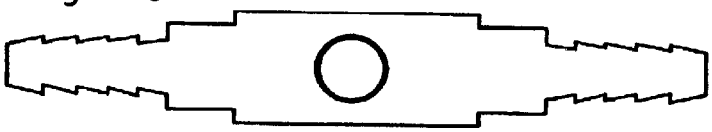
FIG. 3 is a bottom plan view of new multiple output coupler fitting.
Figure 8:
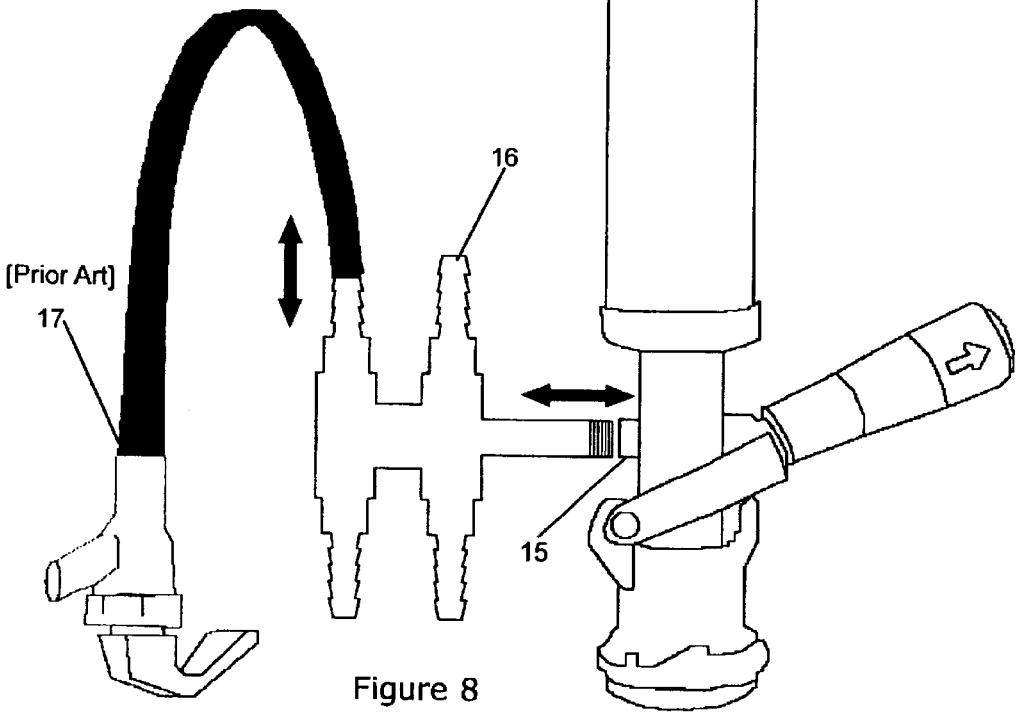
FIG. 8 demonstrates how the multiple output coupler fitting attaches to a standard lever handle coupler and metal pump assembly and to standard food grade vinyl PVC tubing with faucet.

To use the multiple output coupler fitting one simply attaches the ⅛ inch threaded male end (14) as shown in FIG. 4 to the ⅛ inch diameter female input (15) found on standard keg couplers as shown in FIG. 8. Then the barbed hose connectors (16) are fit with the proper ¼ inch inner diameter tubing and faucets (17) as shown in FIG. 8.

For operation a hand pump (18) shown in FIG. 8 is used to pump air into a keg. The pressure forces the liquid out of the keg and through the coupler tubing and finally out through the exit fitting (15). This exit fitting allows connection to the new multiple output coupler fitting which permits about 1600 milliliters per 15 seconds of beverage flow to exit out the multiple outputs as opposed to the traditional coupler and pump assembly with a single output which allows for only 400 milliliters per 15 seconds of beverage flow.

The improvement in output flow created by the multiple output coupler fitting is caused with no physical change to the coupler or pump assembly and furthermore this new multiple output coupler fitting can be used on any type of coupler with the proper ⅛ inch diameter threaded female inlet.

In summary, an improvement in a beverage dispenser has been described. The improvement comprises a beverage dispensing assembly comprising of a beverage container having a beverage dispensing valve attached thereto wherein the beverage dispensing valve has a beverage outlet port comprising a ⅛ inch female threaded connector, the improvement comprising of a multiport outlet manifold with a body having a cavity there within and a hollow, substantially tubular male beverage intake port projecting there from adapted to matingly and removably engage the beverage outlet port on the dispensing valve and provide fluid communication between the beverage outlet port and said cavity furthermore a plurality of tubular nipples extending outwardly from said body, each nipple having an axial channel therein in fluid communication with said cavity and said beverage intake port. In addition said nipples are adapted to sealing and removably engage a fixed end of an elastomeric tubing. A plurality of tubes each having a fixed end attached to one of said nipples in leak proof engagement and free end in opposition thereto. Each of said elastomeric tubes has a length of less than two feet and a valve attached to said free end thereof Although the present invention has been described with reference to specific fitting pieces, numerous modifications and variations can be made and still the result will come within the scope of the invention. No limitation with respect to the specific embodiments disclosed herein is intended or should be inferred.

I claim:

1. An improvement on a keg dispensing apparatus comprising a self contained portable dispensing apparatus "keg tap" which includes; a keg coupler that can be releasably sealed to a tap assembly of a beer keg; said keg coupler having means for locking to said tap assembly of said beer keg; said means for injecting a pressurizing gas further comprising a hand operated air pump as an integral part of said portable dispensing apparatus; a shaft coaxial with and extending into a collar member; said shaft further comprising a passage for beer having a beverage dispensing valve attached thereto wherein the beverage dispensing valve has a beverage outlet port comprising a ⅛ inch female threaded connector, the improvement comprising: (a) a multiport outlet manifold, said multiport outlet manifold comprising a body having a cavity there within and a hollow, substantially tubular male beverage intake port projecting therefrom adapted to matingly and removably engage the beverage outlet port on the dispensing value and provide fluid communication between the beverage outlet port and said cavity; and (b) a plurality of tubular nipples extending outwardly from said body, each nipple having an axial channel therein in fluid communication with said cavity and said beverage intake port; a plurality of elastomeric tubes less than two feet in length, each tube having a fixed end attached to one of said nipples in leakproof engagement and a free end in opposition thereto and a valve attached to said free end thereof.

* * * * *